US007937813B2

(12) United States Patent
Peck et al.

(10) Patent No.: US 7,937,813 B2
(45) Date of Patent: May 10, 2011

(54) CLIP

(75) Inventors: Julian Claude Peck, Newcastle upon Tyne (GB); Jack Harvie-Clark, Newcastle upon Tyne (GB); Kathryn Young, Wells (GB)

(73) Assignee: Innoverce Engineering Ltd., Newcastle Upon Tyne (GB)

( * ) Notice: Subject to any disclaimer, the term of this patent is extended or adjusted under 35 U.S.C. 154(b) by 537 days.

(21) Appl. No.: 11/571,308

(22) PCT Filed: Jul. 1, 2005

(86) PCT No.: PCT/GB2005/002593

§ 371 (c)(1),
(2), (4) Date: Jul. 9, 2007

(87) PCT Pub. No.: WO2006/003415

PCT Pub. Date: Jan. 12, 2006

(65) Prior Publication Data

US 2008/0072403 A1 Mar. 27, 2008

(30) Foreign Application Priority Data

Jul. 2, 2004 (GB) ..... 0414854.0

(51) Int. Cl.
*B42F 1/02* (2006.01)

(52) U.S. Cl. ..... 24/67.9; 24/67.3; 24/67 P; 24/DIG. 8; 24/DIG. 9

(58) Field of Classification Search ..... 24/67.9, 24/67 P, 67.3, 67 R, 545, 547, DIG. 8, DIG. 9; 132/273, 276, 277
See application file for complete search history.

(56) References Cited

U.S. PATENT DOCUMENTS

| | | | | | |
|---|---|---|---|---|---|
| 616,385 | A | * | 12/1898 | Winget | 248/504 |
| 2,009,941 | A | * | 7/1935 | Mix | 24/66.13 |
| 3,082,773 | A | | 3/1963 | Renstrom et al. | |
| D202,016 | S | | 8/1965 | Soloman | |
| 3,416,202 | A | | 12/1968 | Sasaoka | |
| 3,898,717 | A | | 8/1975 | Schwartz | |
| 4,011,639 | A | | 3/1977 | Koleske | |
| 4,397,577 | A | | 8/1983 | Bauer | |
| 4,716,634 | A | * | 1/1988 | Fan | 24/545 |
| 4,738,007 | A | | 4/1988 | Demarest, Jr. | |

(Continued)

FOREIGN PATENT DOCUMENTS

CN 101005950 (A) 7/2007

(Continued)

OTHER PUBLICATIONS

Avallone, E.A.; Baumeister, T., III (1996). Marks' Standard Handbook for Mechanical Engineers (10th Edition). (p. 5-9). McGraw-Hill.*

(Continued)

*Primary Examiner* — Daniel P Stodola
*Assistant Examiner* — Michael Lee
(74) *Attorney, Agent, or Firm* — Daly, Crowley, Mofford & Durkee, LLP

(57) ABSTRACT

A bistable clip suitable for clipping sheaves of paper, made from sheet metal with at least one hole in its upper surface (3), which toggles between a stable open position (for putting papers in or taking papers out) and a stable closed position (for gripping the papers), and which comprises a spine (2) stiffened to some degree by the shaping of the material in the spine (2).

15 Claims, 6 Drawing Sheets

U.S. PATENT DOCUMENTS

| | | | | | |
|---|---|---|---|---|---|
| 4,793,030 | A | | 12/1988 | Hirsch | |
| 4,947,524 | A | * | 8/1990 | Chang | 24/67.9 |
| 4,991,269 | A | * | 2/1991 | Kuroda | 24/67.11 |
| 5,113,554 | A | * | 5/1992 | Gallo et al. | 24/545 |
| 5,136,754 | A | * | 8/1992 | Kuroda | 24/67.9 |
| D392,415 | S | | 3/1998 | Liao | |
| 6,418,595 | B1 | * | 7/2002 | Shih | 24/536 |
| 2002/0095748 | A1 | | 7/2002 | Tani | |

FOREIGN PATENT DOCUMENTS

| | | | |
|---|---|---|---|
| DE | 80280 | | 9/1894 |
| DE | 42 39 544 | | 11/1994 |
| EP | 1 708 883 | B1 | 5/2008 |
| GB | 2 415 735 | A | 1/2006 |
| JP | 11-42878 | | 2/1999 |
| JP | 2000-190670 | | 7/2000 |
| WO | WO9621573 | | 7/1996 |
| WO | WO 2006/003415 | A1 | 1/2006 |

OTHER PUBLICATIONS

Avallone, E.A.; Baumeister, T., III (1996). Marks' Standard Handbook for Mechanical Engineers (10th Edition). (p. 5-9). McGraw-Hill. (One Page Only).*

International Search Report, PCT/GB2005/002593, Nov. 2, 2005, (Form PCT/ISA/210), 3 pages.

GB Search Report dated Sep. 25, 2009 for GB 0911107.1.

EP Office Action dated Nov. 15, 2006 for 05 756 954.3—1251.

Chinese Office Action (with English Translation) dated Nov. 21, 2008 for 2005-80022274X.

GB Search Report dated Oct. 18, 2004 for GB 0414854.0.

PCT International Preliminary Report on Patentability and Written Opinion of the ISA for PCT/GB2005/002593 dated Jul. 1, 2007.

Response to First Chinese Office Action (full translation); filed on Mar. 31, 2009; for CN200580022274X; 8 sheets.

Chinese Office Action (full translation); dated Aug. 23, 2010; for CN200580022274X; 2 sheets.

Response to Second Chinese Office Action (full translation); filed on Oct. 19, 2010; for CN200580022274X; 4 sheets.

Great Britain Response to Office Action; dated Jun. 10, 2010; for GB0911107.1; 2 sheets.

Letter from British Patent Office with: Response made to Report under Section 18(3); dated Jul. 14, 2010; for GB0911107.1; 1 sheet.

Search Report of British Patent Office; dated Sep. 25, 2009; for GB0911107.1; 5 sheets.

Request for entry into European Phase Form 1200; for PCT/GB2005/002593; filed on Jun. 27, 2006; 8 sheets.

EPO First Office Action; dated Nov. 15, 2006; for EP 05 756 954.3; 4 sheets.

EPO Response to First Office Action filed Dec. 19, 2006; for EP 05 756 954.3; 6 sheets.

EPO Letter Response to telephone call with Examiner; filed on Sep. 25, 2007; for EP 05 756 954.3; 5 sheets.

EPO notice of intent to grant patent with proposed text with further minor clarifications and with summary of telephone call; dated Nov. 12, 2007; for EP 05 756 954.3; 34 sheets.

* cited by examiner

SECTION A-A

SECTION B-B

SECTION A-A

SECTION B-B

Figure 9
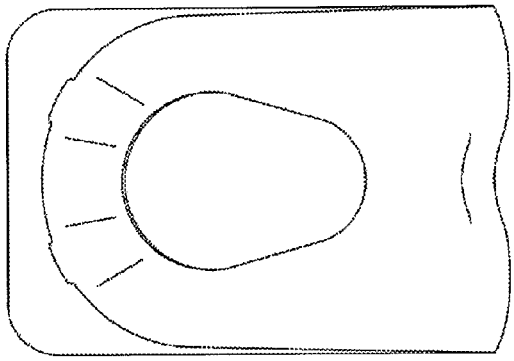
Figure 10
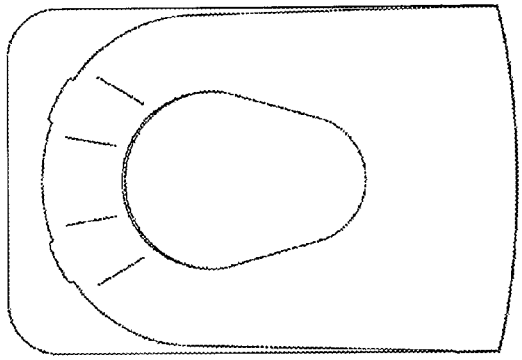
Figure 11
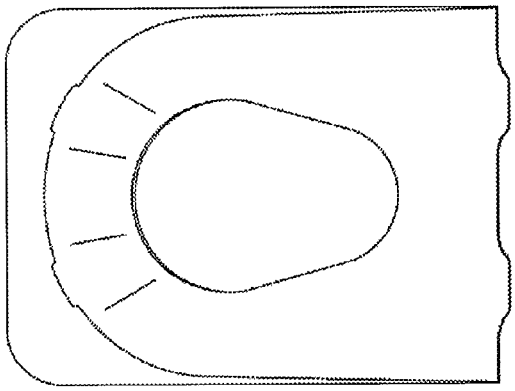
Figure 12
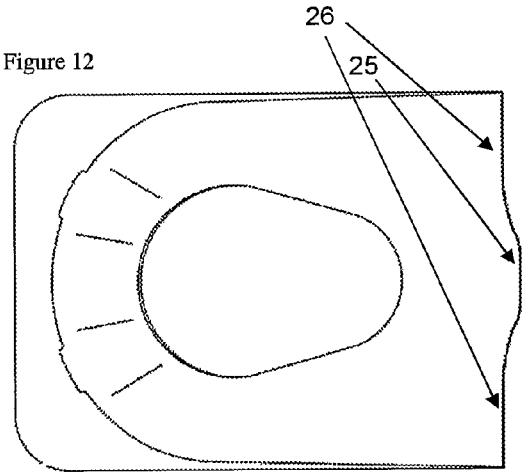
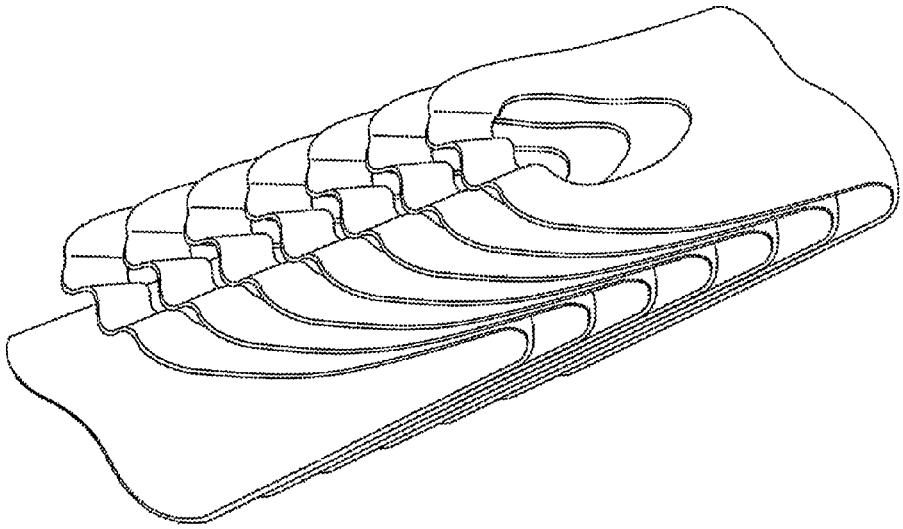
Figure 13

Detail of Figure 22

Detail of Figure 23

CLIP

CROSS REFERENCE TO RELATED APPLICATIONS

This application is a National Stage Application under 35 U.S.C. §371 of International Application number PCT/GB2005/002593 filed on Jul. 1, 2005, which was published in the English language on Jan. 12, 2006 as International Publication Number WO 2006/003415, and which claims the benefit under 35 U.S.C. §119(a) of Great Britain Patent Application number 0414854.0 filed on Jul. 2, 2004.

This invention relates to a bistable clip suitable for clasping or clamping together two or more items. This clip has numerous possible applications, and is particularly well suited to joining together sheets of paper.

Many different kinds of paperclip are already known in the prior art. In particular, many bistable paperclips are already known. Many of these bistable paperclips are manufactured from a single piece of sheet metal, folded over into a U-shape and the present invention is applicable to such clips, which are termed herein 'foldover clips'. The foldover area of such foldover clips is termed herein the 'spine'. Examples of foldover clips include U.S. Pat. No. 5,136,754, US2002/0095748, U.S. Pat. No. 4,991,269, WO96/21573, U.S. Pat. Nos. 3,898,717, 4,947,524, JP11-042878, JP2000-190670 and U.S. Pat. No. 4,793,030.

Probably the most commercially successful bistable clip currently on the market is not a paperclip at all but a hairclip. Hairclips do not usually incorporate such a foldover feature. Good examples are shown in U.S. Pat. Nos. 3,082,773, 4,011,639, and in Utility Patents USD392415 and USD202016. Paperclips have also been designed in a similar way, without a foldover feature, such as U.S. Pat. No. 4,397,577. Such devices, without any foldover feature, are termed herein 'hairclips'.

The basic bistable clip as shown in DE 80280 is neither a foldover clip nor a hairclip. It is a clip made from two pieces of sheet metal, having a flat lower surface (to be positioned beneath the pages) and an upper surface, which exhibits bistability on account of a central dent. The clip can be closed onto the papers by pressing on the front edge, causing it to toggle from its open position to its closed position, and can then be released by pressing on the central dent, which causes the clip to toggle back into its open position.

However, the paperclip described in DE 80280 does not give enough movement (between its open and closed positions) to allow the clip to be very useful. Most of the foldover clips mentioned above incorporate one or more holes in their bistable surface, which allows them to give more movement. Even so, the design of such clips requires a compromise in selecting the thickness of the material from which the clip is to be made. The clip must be made of material thin enough to allow sufficient shape change between the clip's stable open position and its stable closed position. However, it must also be made of material thick enough to provide sufficient clamping force to grip the papers, without causing the material in and around the spine to be strained beyond its elastic limit.

These conflicting requirements create a contradiction, which necessitates a compromise. The present invention seeks to improve on existing foldover clips by providing a means of overcoming this compromise, enabling a foldover clip to be manufactured from thinner material and still to provide ample clamping force to grip the papers. In the present invention, the stiffness of the clip (its resistance to opening when in use) is greatly increased because the side-profile of the clip is deeper than the thickness of the material throughout the side-profile, and most especially in and around the spine.

According to the present invention there is provided a clip comprising a single piece of material folded to form first and second members arranged to receive an item or items to be clipped therebetween, said first member having an aperture therein with at least some of the material around said aperture being plastically deformed whereby said first member has a first position of stability in which at least the free end of said first member has a generally convex shape and a second position of stability in which at least the free end of said first member has a generally concave shape, in which at least part of said material in the fold is shaped so as to resist forces tending to open said fold.

Also according to the present invention there is provided a clip comprising first and second members joined so as to be arranged to receive an item or items to be clipped therebetween, said first member being formed of a sheet material and having an aperture therein with at least some of the material around said aperture being plastically deformed whereby said first member has a first position of stability in which at least the free end of said first member has a generally convex shape and a second position of stability in which at least the free end of said first member has a generally concave shape, said second member being sufficiently stiff to substantially retain its shape regardless of the position of said first member, said clip being formed of a single piece of sheet material folded to form said first and second members joined by a fold section, said sheet material having an outer face comprising one surface of said first member and one surface of said fold section and one surface of said second member, and an inner face comprising the opposite surface of said first member and the opposite face of said fold section and the opposite surface of said second member, and said fold section being formed such that when said clip is viewed from one side, it is possible to see not only the edge of the clip but also at least part of the outer surface of said first member and at least part of the outer surface of said fold section.

Also according to the present invention there is provided a clip comprising first and second members joined so as to be arranged to receive an item or items to be clipped therebetween, said first member being formed of a sheet material and having an aperture therein with at least some of the material around said aperture being plastically deformed whereby said first member has a first position of stability in which at least the free end of said first member has a generally convex shape and a second position of stability in which at least the free end of said first member has a generally concave shape, said second member being sufficiently stiff to substantially retain its shape regardless of the position of said first member, said clip being formed of a single piece of sheet material folded to form said first and second members joined by a fold section, and said fold section comprising at least one region in which said sheet material has been deformed (eg spheroidally) into a three-dimensional shape which cannot be created by two-dimensional bending alone, and which therefore prevents said clip being unwrapped or developed onto a flat surface.

Herein, the first member is termed the upper surface, and the second member is termed the lower surface.

At least some embodiments of the present invention can be understood as bistable clips which derive some or all of their bistability by having an inner edge which is permanently in compression and an outer edge which is permanently in tension. DE 80280 achieves bistability by plastic deformation of the upper surface into a dome-like structure, whereas hairclips achieve this by an elastic deformation into an irregular frustoconical shape. The overall performance of the clip is improved if the permanent compression in the inner edge is created by means of an elastic deformation of the majority of the upper surface, rather than by a plastic deformation of the majority of the upper surface, although this elastic deformation is created by means of localised plastic deformation(s).

In this arrangement, even when the clip is in its stable open position or its stable closed position, most of the inner edge (the edge of the hole) is in compression, and the act of toggling the clip between these two stable positions increases the compression along this inner edge.

Some objectives achieved by at least some preferred embodiments of the present invention are as follows:

The clips should be able to hold securely any quantity of papers between a minimum of two sheets and a maximum which should be quite a thick sheaf of papers.

The clips should be easy to remove and re-apply manually (without using any other tools), ideally with a 'push-button' modus operandi.

The clips should have surfaces suitable for overprinting with corporate branding.

The clips should be capable of 'nesting' together in order to:

prevent them from tangling;

reduce the space they take up.

The clips should have a fairly low profile on the papers, without adding too much thickness to the sheaf of papers being secured.

The clips should be manufacturable at very low cost, in very high volumes.

The clips should be re-usable.

In some preferred embodiments, the plastic deformation around the aperture in the upper surface may be done by crimping the front edge of the clip, which creates tension across the front of the clip and around the outer edge of the upper surface, but creates compression around most of the edge of the hole in the upper surface.

In other preferred embodiments, the plastic deformation around the aperture in the upper surface may be done by peening part or all of the perimeter of the aperture, which creates hoop tension around some or all of the outer edge and hoop compression around some or all of the inner edge.

In preferred embodiments, at least part of the lower surface is gently corrugated, the corrugations running in a direction substantially perpendicular to the axis of the curved spine. These corrugations greatly increase the rigidity of the lower surface, and are especially important close to the curved spine as this region is subject to the highest bending moments.

In preferred embodiments, the corrugations propagate around at least part of the curved spine to form one or more bumps, greatly increasing the rigidity of the curved spine.

In some preferred embodiments, the upper surface comprises more than one hole. Such embodiments have different performance characteristics, according to the configuration of the holes in the upper surface. For example, one embodiment has a pair of holes separated by a compressive strut, the axis of the compressive strut being substantially perpendicular to the axis of the curved spine. This compressive strut can improve the bistable performance of the clip, and also provides a convenient position on which to press to toggle the clip from its closed position to its open position, and also helps to prevent papers which are being inserted into the open clip from catching on the back edge of the hole.

In some preferred embodiments, the upper surface and/or the lower surface further comprise teeth, these teeth being designed to bite into the upper and/or lower pages being clipped together. In some embodiments, the teeth are not sharp but are elongated into a flange, which provides a compromise between the embodiments with teeth and those without teeth.

In preferred embodiments, the clips can be nested together so the clips take up less space and to prevent the clips tangling with each other.

It will be appreciated therefore that embodiments of the present invention have advantages over conventional ('gem' type) paperclips, and also over conventional foldover clips. These and other features of the invention will be better understood from the following description of the two-bump embodiment which is given by way of example and with reference to the accompanying drawings in which:

FIG. 9 shows a plan view of the two-bump embodiment, in the closed position.

FIG. 10 shows a plan view of the one-bump embodiment, in the closed position.

FIG. 11 shows a plan view of the two-ridge embodiment, in the closed position.

FIG. 12 shows a plan view of the one-ridge embodiment, in the closed position.

FIG. 13 shows a perspective view of several clips according to the smooth embodiment, in the open position, nested together.

The two-bump embodiment of the present invention will now be described by reference to the accompanying figures.

Figure 1:
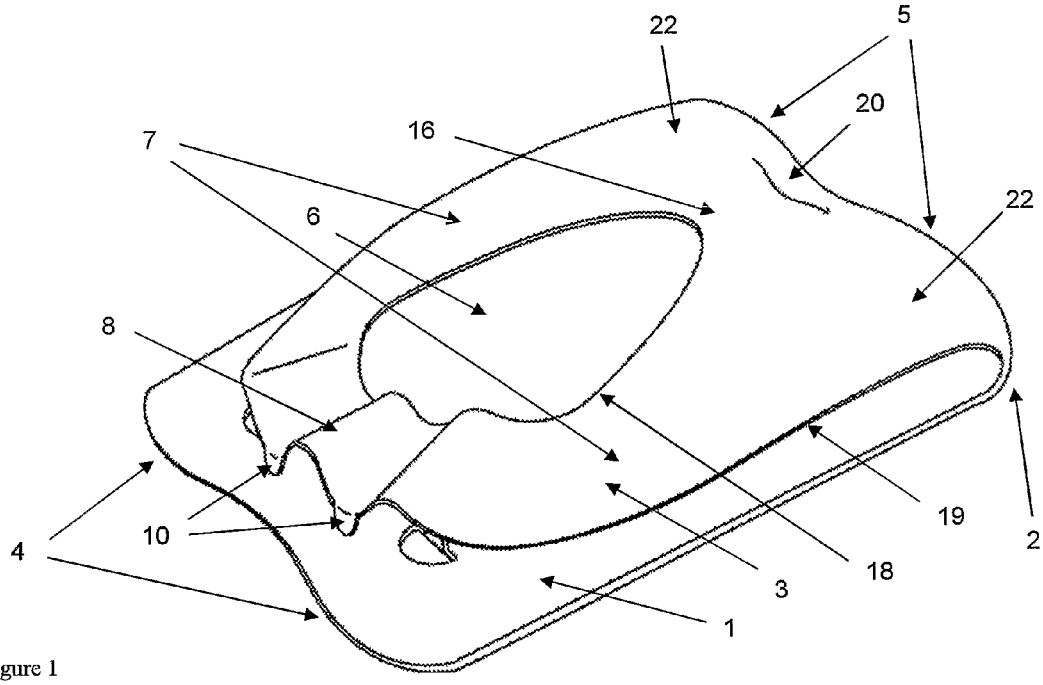
FIG. 1 shows a perspective view of the two-bump embodiment, in the closed position.
Figure 2:
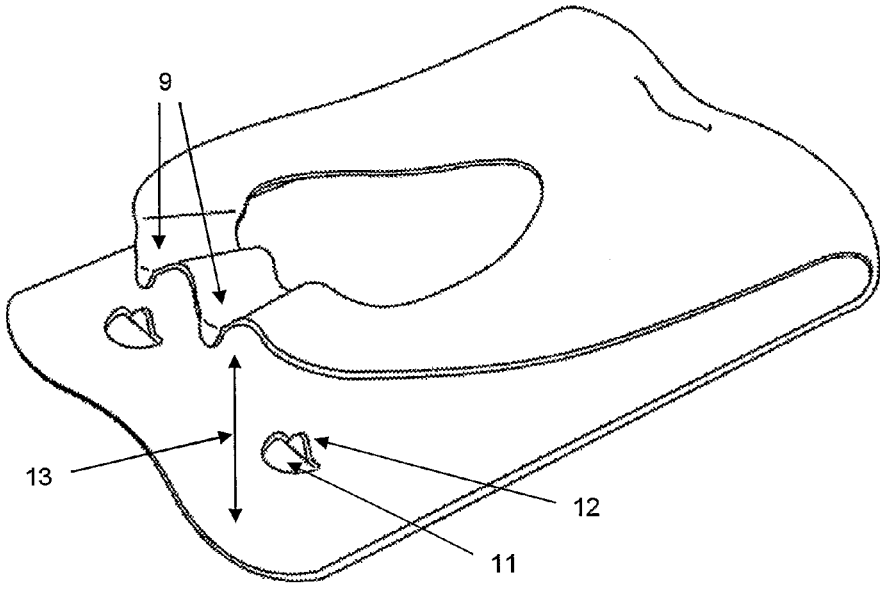
FIG. 2 shows a perspective view of the two-bump embodiment, in the open position.

FIGS. 1 and 2 show a clip comprising a lower surface 1, a curved spine 2 and an upper surface 3. The perimeter of the upper surface 3 comprises an outer edge 19, except where the upper surface 3 meets the spine 2. The lower surface 1 comprises a pair of corrugations 4 which extend around the spine 2 where they create a pair of bumps 5. The upper surface 3 comprises a hole 6, the perimeter of which comprises an inner edge 18, and the hole 6 separates a pair of arms 7. Behind the hole 6 is a high point 16, and behind the high point 16 is a dimple 20. At the front of the hole 6, the arms 7 meet at a nose 8. The nose 8 comprises a pair of crimps 9, and at the front of each crimp 9 there is a single top tooth 10 pointing towards the lower surface 1. Towards the back of the upper surface 3, there is a transition region 22 where the curvature is in transition between the double-bump profile of the spine 2 and the approximately frustoconical bistable region of the upper surface 3.

FIGS. 3 to 9 show various views of the two-bump embodiment. This clip is manufactured from a thin sheet of steel having two faces, which is folded over into a U-shape such that one of these faces becomes an inner face 27 and the other becomes an outer face 28. In FIGS. 3 to 8, the inner face is shaded to distinguish it from the outer face, which is unshaded.

FIGS. 1 and 2 also show that the lower surface 1 has a pair of holes 11 at the back of which a pair of bottom teeth 12 are formed, pointing towards the upper surface 3.

Figure 14:
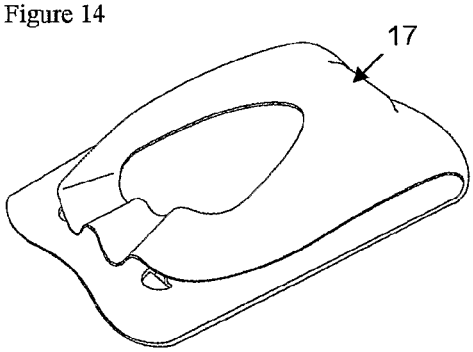
FIG. 14 shows a perspective view of the humped embodiment, in the closed position.
Figure 16:
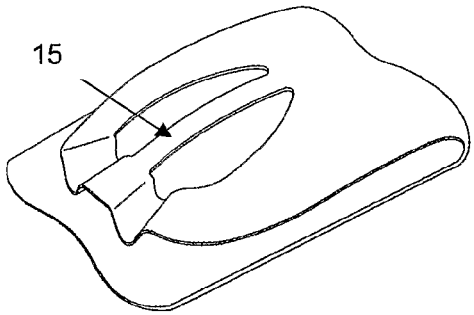
FIG. 16 shows a perspective view of the strut embodiment, in the closed position.
Figure 17:
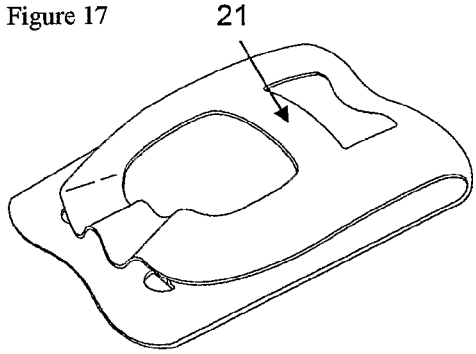
FIG. 17 shows a perspective view of the bridge embodiment, in the closed position.
Figure 20:
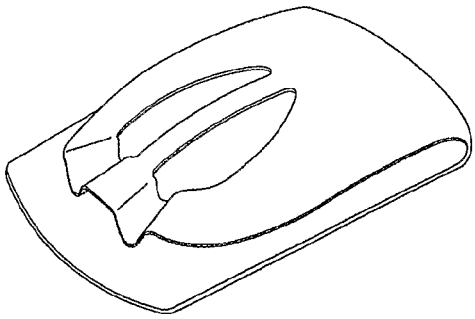
FIG. 20 shows a perspective view of the one-bump embodiment, in the closed position.
Figure 23:
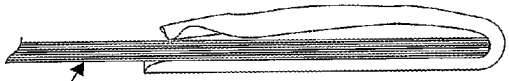
FIG. 23 shows a side view of the two-bump embodiment, closed onto a thick sheaf of papers, showing how the increased clamping force grips the papers.
Figure 23:
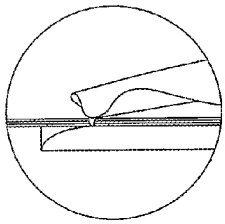
Figure 23:
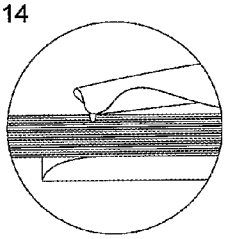

When the clip is in the open position it has an open mouth 13. FIG. 23 shows the clip closed onto a thick sheaf of papers 14. FIG. 14 shows a clip which has a hump 17, FIGS. 16 and 20 show clips which have an additional longitudinal strut 15, and FIG. 17 shows a clip which has an additional transverse bridge 21.

Herein the spine end of the clip is termed the 'back' and the nose end of the clip is termed the 'front'.

Figure 3:
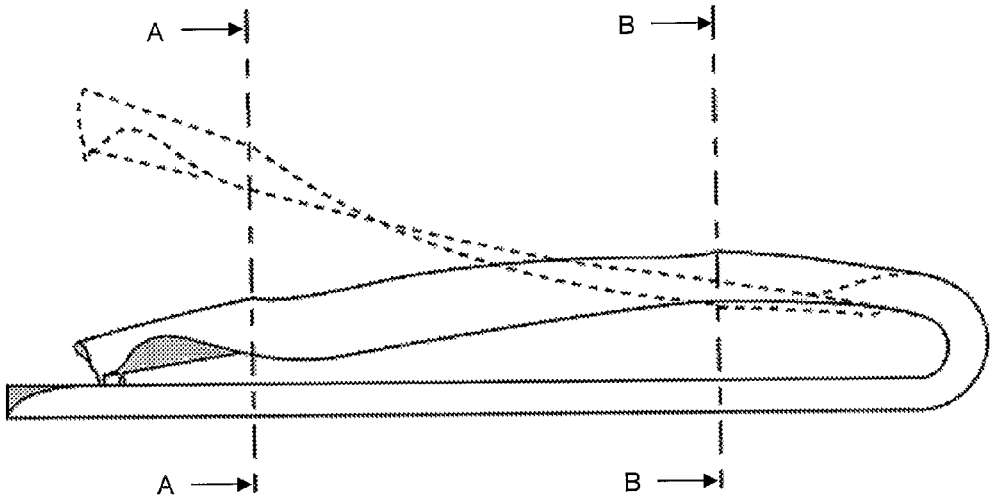
FIG. 3 shows a side view of the two-bump embodiment, in the closed position.

Referring to FIG. 3, the bending stresses in the clip caused by its clamping action are low in the region to the left of plane A-A, moderate between plane A-A and plane B-B, and high to the right of plane B-B. For a given thickness of steel, the present invention is stiffer than other foldover clips with planar or cylindrical spines because of the geometry in the region to the right of plane B-B. In this region, the curvature in the lower surface caused by the corrugations, and the curvature in the spine caused by the two bumps, and the curvature in the transition region, ensure that the profile subject to the bending stresses are all considerably thicker than the thickness of the steel. The stiffness throughout the region to the right of plane B-B is associated with the fact that the outer face of the lower surface, and of the spine, and of the transition region are all visible in the side-profile of the clip shown in FIG. 3.

In the two-bump embodiment, each bump is essentially barrel-shaped. The shape of the material in the spine is essentially that created by sweeping the corrugated profile of the lower surface (as shown in FIGS. 4, 5, 7 and 8) around an arc. Starting from a substantially flat sheet, this shape cannot be created by two-dimensional bending alone as it requires the material to be stretched and/or compressed and/or sheared to form such a shape. The radius of curvature around the axis of the spine therefore varies along the length of the spine, such that it is greater at the centre of each bump (where material has been stretched) and is less between and outside the bumps (where the material may have been compressed). The stretching and compression can be understood by considering the length of the arc through which the corrugated profile of the lower surface has been swept, which is longer near the centre of each bump, and shorter between and outside the bumps.

Figure 29:
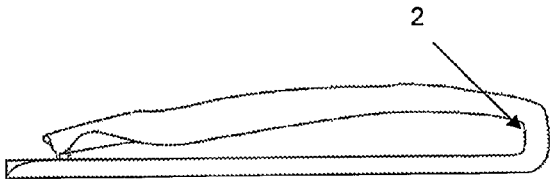
FIG. 29 shows a side view of an embodiment with a spine which does not have a circular profile.

FIG. 29 shows a side view of an embodiment with a spine which does not have a circular profile. The three-dimensional shape of the spine in this embodiment is essentially that created by sweeping the corrugated profile of the lower surface along a curve which is not an arc. The present invention is not limited to clips wherein the shape of any section through the spine would be an arc of a circle.

The operation of the two-bump embodiment will now be described by reference to the figures.

Figure 7:
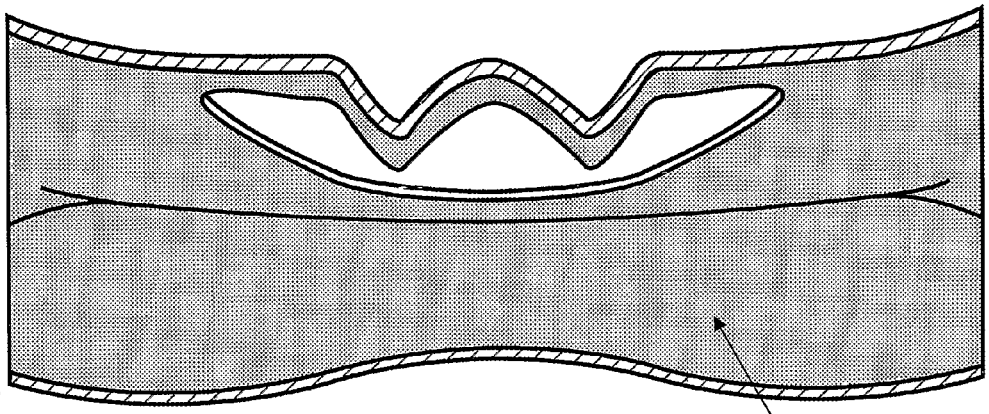
FIG. 7 shows a first section through the two-bump embodiment, in the closed position.
Figure 8:
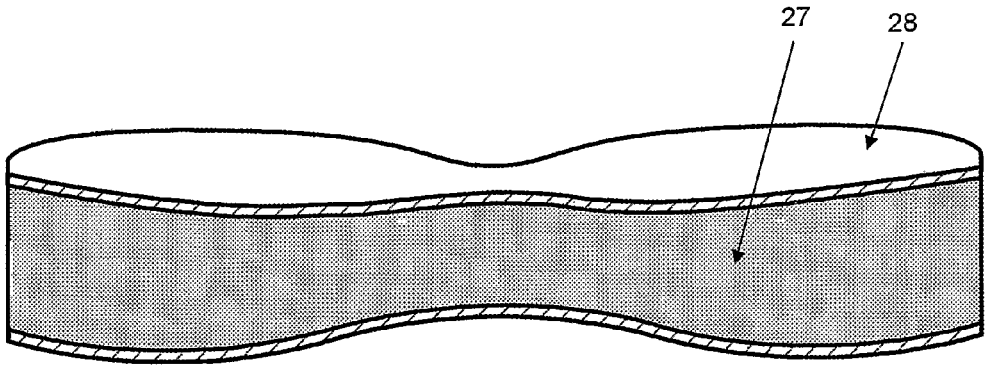
FIG. 8 shows a second section through the two-bump embodiment, in the closed position.

When the clip is in the open position (as shown in FIG. 2), its mouth 13 is open wide enough to accept a generous sheaf of papers 14. The outer edge 19 of the upper surface 3 is in tension and makes the outer face 28 of the upper surface 3 substantially concave as shown in FIGS. 7 and 8. The clip can easily be placed around the papers 14 until the edge of the papers 14 reaches the spine 2 which acts as an end-stop for the papers 14. The clip can then be closed onto the papers 14 simply by pressing on the nose 8 of the clip. This pressure . causes the clip to toggle from its stable open position into its stable closed position, as shown in FIG. 1.

Figure 4:
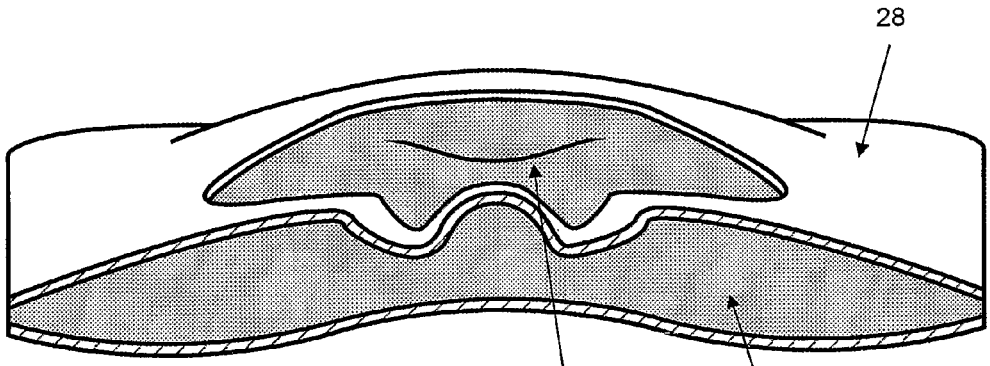
FIG. 4 shows a first section through the two-bump embodiment, in the closed position.
Figure 5:
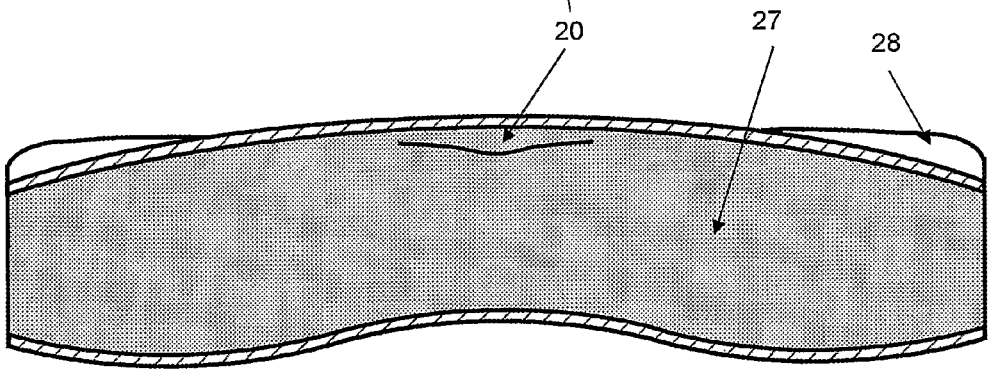
FIG. 5 shows a second section through the two-bump embodiment, in the closed position.
Figure 6:
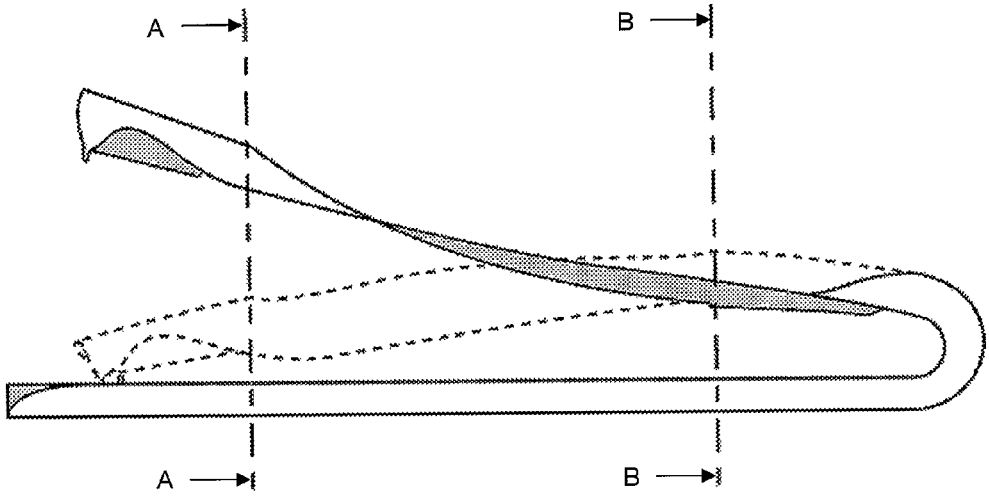
FIG. 6 shows a side view of the two-bump embodiment, in the open position.

When the clip is in its closed position (as shown in FIG. 1), the outer edge 19 of the upper surface 3 is in tension and makes the outer face 28 of the upper surface 3 substantially convex as shown in FIGS. 4 and 5.

The clamping force generated between the nose 8 and the lower surface 1 depends on many factors, but because the clip acts as a spring the clamping force depends on the thickness of the sheaf of papers being clamped. If the sheaf is thick (as shown in FIG. 23) the clamping force is large, but if the sheaf is thin (as shown in FIG. 22) the clamping force is less.

Figure 22:
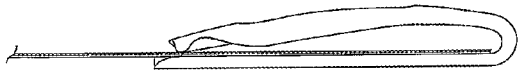
FIG. 22 shows a side view of the two-bump embodiment, closed onto a small number of papers, showing how the teeth grip the papers.

The upper teeth 10 and lower teeth 12 are therefore designed to assist in retaining the papers 14 securely when the clip is used on a small sheaf of papers as shown in FIG. 22. The upper teeth 10 and lower teeth 12 will pierce the papers 14 making the clip as secure as a staple. Often, the papers cannot be removed without tearing them.

On a larger sheaf of papers, the upper teeth 10 and lower teeth 12 will pierce several sheets at the top of the sheaf and several sheets at the bottom of the sheaf, but the middle sheets will be held just by the clamping force of the clip. This force is sufficient to grip such papers quite securely.

Now that the clip is in a closed position as shown in FIG. 1, it can be toggled into its open position to release the papers by pressing on the high point 16 of the clip. This pressure causes the clip to toggle from its stable closed position back into its stable open position. The clip can then be removed from the papers 14.

It is important to understand how the clip is designed to exhibit the behaviour described above.

An important aspect of the design of the present invention is selecting appropriate material of appropriate thickness. Preferred embodiments are made from spring steel, which may be either a carbon spring steel or a stainless spring steel.

The material thickness is important. If the material is too thin then it will not have the strength to grip the papers strongly enough, but if the material is too thick then this will prevent the shape of the bistable upper surface changing enough before reaching its elastic limit.

It is for this reason that preferred embodiments of the present invention use relatively thin material, stiffened by corrugations in the lower surface and bumps in the spine. These features stiffen the material in the spine and lower surface, whilst allowing a generous amount of movement in the upper surface.

For example, the peened embodiment can be manufactured from 0.25 mm thick high-tensile stainless steel sheet, and is about 25 mm long and 20 mm wide. These dimensions are not limiting, and in particular the clip can be reduced in size. A smaller clip might be made from thinner material.

It is easy to corrugate the lower surface as this is a simple bending operation, but it is difficult to put bumps into the spine because this requires the material to be stretched and/or sheared and/or buckled. Some techniques for making these bumps and for avoiding buckling will be described later.

The lower surface and spine can be stiffened by one corrugation/bump, but this is less effective than stiffening them with two corrugations/bumps. The reason for this is that the spine with one bump is surprisingly flexible. The bump comprises material curved spheroidally in two orthogonal directions (around the axis of the spine, and also to form the corrugation) and the curvature can be transferred between these two directions. This means that the clip's clamping force is low, because it can open easily by transferring the curvature about the axis of the hinge into a deeper bump. The clip with two bumps is much stiffer because there is much more resistance to this complex mode of elastic deformation.

FIGS. 4, 5, 7 and 8 show the corrugations in cross-sections through the lower surface of the two-bump embodiment and FIG. 9 shows how the same curvature continues to form the bumps in the spine.

The hole in the upper surface is an important feature. The front edge of the hole is held in tension by the crimps, but the back edge and especially the side edges are in compression, and these compression members behave as bucklable struts. This bucklability is the source of the clip's bistability.

Unlike the plastically deformed dome structure described in DE 80280 which requires the material to be stretched to form the dome, the upper surface of most embodiments of the present invention is a flat sheet subjected to elastic deformations, similar to hairclips. Apart from the crimping or peening, the upper surface is deformed only by elastic bending (not by stretching or shearing). A flat sheet can only be elastically bent into two possible shapes, a cylinder or a cone—and in the case of the present invention the upper surface is deformed into an irregular but approximately frustoconical shape, rather like a thin Belleville washer.

This frustoconical shape makes the side profile of the upper surface considerably deeper than the thickness of the material, which therefore gives the upper surface good stiffness. The lower surface is stiffened by the corrugations and the spine is stiffened by the bumps, but there could still be a less stiff region around the transition between the frustoconical upper surface and the two bumps. In some preferred embodiments, there is either a central dimple or a central hump behind the high point which helps to prevent there being any transitional weak section between the upper surface and the spine. This dimple or hump also makes the clip easier to manufacture, for reasons described later.

In preferred embodiments of the present invention, the frustoconical shape of the upper surface has a highly desirable but counter-intuitive stiffening characteristic. When the clip is in the closed position and a force is applied to the upper teeth, this force does not have any tendency to toggle the clip. Instead, such a force increases the tension in the outer edges of the upper surface of the clip, thereby deepening the conical form, increasing the depth of the side profile of the upper surface and stiffening the structure, making it more stable in its closed position.

In the crimped embodiments (all except the peened and coned embodiments), the frustoconical upper surface is formed by internal stresses which arise when the nose of the clip is narrowed by the crimps 9 being created by plastic deformation of the nose 8. The frustoconical shape could be made by means other than crimping, but crimping has several advantages:

- It is relatively easy to do and requires no additional components
- It creates useful places to position the upper teeth
- It allows the bistability of the clip to be biased towards either the open or (more desirably) the closed position
- It ensures that the force on the upper surface from the sheaf of papers acts at the correct point to ensure the effectiveness of the desirable but counter-intuitive stiffening characteristic described above
- It is relatively easy to create a relatively small amount of plastic deformation.

Hairclips require a much larger reduction in the width of the nose, so they are usually riveted. Riveting is relatively expensive, and is also inappropriate for making small reductions in the width of the nose. The 25 mm×20 mm embodiment of the present invention requires a reduction in the width of the nose of about 1 mm.

Figure 18:
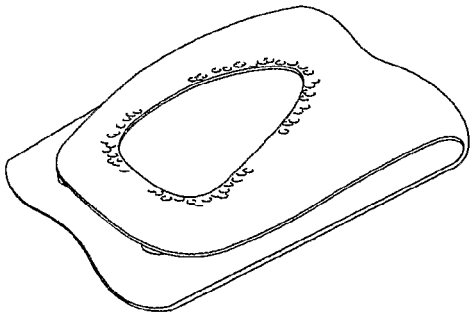
FIG. 18 shows a perspective view of the peened embodiment, in the closed position.

Hairclips are also sometimes peened, with a single blow at each end of the elongated hole in the upper surface of the hairclip. The internal stresses which create the frustoconcal shape of the present invention may also be made by peening, as shown in FIG. 18.

On both sides of the hole in the upper surface are the arms of the clip. In preferred embodiments, the arms of the clip become broader towards the back of the clip, causing the hole to become narrower. The best way to get the maximum shape-change from the upper surface is for the entire upper surface to be more or less uniformly deformed, being bent to a more or less constant radius of curvature, such radius being limited by the elastic limit of the material.

Preferred embodiments of the present invention achieve this condition by making the arms wider towards the back of the clip. The broadening of the arms towards the back of the clip also increases the stiffness around the back of the clip, where the bending moment is greatest.

The present invention may be manufactured with or without upper teeth, and with or without lower teeth. Without teeth, it operates purely as a paperclip and relies totally on:

- the clamping force between the upper and lower surfaces;
- friction between the papers and the clip;
- friction between one sheet of paper and the next.

There is, in general, more friction between one sheet of paper and the next than between papers and the clip. The ability of the clip to hold papers securely is therefore greatly enhanced by teeth, even if these teeth are so small that they only penetrate one sheet of paper.

In some embodiments, the teeth are large enough to pierce (or at least dent) several sheets of paper, as this improves the ability of the clip to hold papers securely.

Figure 21:
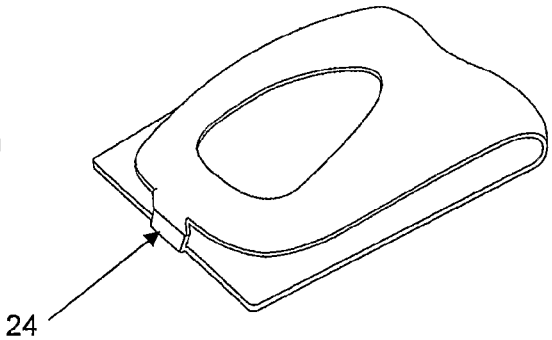
FIG. 21 shows a perspective view of the flanged embodiment, in the closed position.

The damage caused to papers by the teeth is a disadvantage, which may be substantially overcome if the teeth are replaced by elongated flanges. A clip with such flanges such as that shown in FIG. 21 will do less damage to the papers than would be caused by teeth, but will grip the papers more securely than a clip without either teeth or flanges.

Whilst the design of the clip may look quite simple, it can be difficult to manufacture the bumps in the spine. One way to make the two-bump embodiment of the present invention is as follows.

1. Blanking. The two-dimensional developed shape is pressed out from sheet steel.
2. Pre-curving. This is an optional initial plastic deformation designed to impart some residual stresses into the steel. The two-dimensional blank is gently curved along its length (perpendicular to the spine).
3. Corrugating. The corrugations in the lower surface are made by plastic deformation along about half the length of the blank.
4. Spine Bending. The spine is bent plastically around either a cylindrical former (a diameter of about 3 mm is appropriate), or a former which is shaped so as to form the two bumps. In either case, the Spine Bending process removes some of the pre-curve and bumps from the spine area, but will leave some residual stresses from these earlier plastic deformations. The spine should be bent to about 180 degrees, but springback will leave a final angle of about 150 degrees at this stage.
5. Bump Forming. The two bumps are re-formed in the spine using a progressive series of punches and dies. This operation requires the steel to be sheared, stretched and compressed to form the correct shape. This operation causes the material to buckle where it is in compression and is therefore best done using a progressive series of punches and dies to keep control of the buckling. The first punch and die pair will have a spine which is almost cylindrical in form (with just very shallow bumps), then each punch and die pair will have progressively more curvature until the final pair finish forming the bumps. The hump or dimple is formed at the same time as the bumps, and in either case provides somewhere for the excess material from between the bumps to move to.
6. Crimping. The crimps are formed in the nose of the clip using appropriately shaped punches and dies. This may have to be done in several stages to avoid stretching the material while forming the crimps. The material may tend to stretch if there is too much friction between the clip and the tooling. The clip should ideally be crimped into an open position, as otherwise it will have to be toggled before the next operation.
7. Tooth forming. The material is bent locally to form the teeth.
8. Biasing. The clip should ideally be very stable when closed, but only slightly stable when open. The bias can be adjusted at this stage by subtle plastic deformations of the crimps or other parts of the upper surface.
9. Spine squeezing. At this stage, the clip may still be wide open due to the springback from the spine bending, although the exact angle may have been affected by subsequent operations. The final stage is therefore to squeeze the spine of the clip to the correct angle. This is best done with the clip toggled into its open position.

In some circumstances, the sequence of these stages may be altered to suit manufacturing requirements.

The 'Bump Forming' process may be the most difficult of these processes, because this process requires the material to be plastically stretched and/or sheared and/or compressed. The other processes are simpler, as they are just bending processes. Plastic compression may be undesirable as it tends to make the material buckle, but plastic compression is avoidable if the clip is manufactured with one or two ridges 25 as shown in FIGS. 11 and 12, instead of with one or two bumps as shown in FIGS. 9 and 10.

FIG. 12 shows the one-ridge embodiment, which is a clip with one ridge located between a pair of substantially cylindrical sections 26. The cylindrical sections are made by simple bending during the 'Spine Bending' process above, and remain substantially undeformed by the subsequent 'Bump Forming' process. During the 'Bump Forming' process for the one-ridge embodiment, the ridge is formed by stretching the material in the ridge and shearing the material in the region between the ridge and the cylindrical sections. The tensile force required to stretch the material in this region is counterbalanced by a compressive force in the cylindrical sections, but this compressive force is distributed through the cylindrical sections in such a way that the compressive stress levels in the cylindrical sections do not exceed the elastic limit of the material, so the material does not buckle. Furthermore, because the cylindrical sections are not being deformed during the 'Bump Forming' process, the tooling may be designed so that during this process the cylindrical sections are clamped firmly between the die and a temporarily stationary part of the punch, while a moving part of the punch stretches and shears the material between the cylindrical sections to form the ridge. The retention of the cylindrical sections during the forming process also helps to prevent buckling during the 'Bump Forming' process. The two-ridge embodiment shown in FIG. 11 may be formed in a similar way.

Depending on the geometry of the ridge or ridges in the one-ridge or two-ridge embodiment, it may also be possible to form the ridges in the spine during the corrugating operation and to retain them during the spine bending operation by bending the spine around a shaped former, in which case the bump forming operation may not be required.

It is not possible to achieve the fall benefit of the present invention without creating some 'spheroidality' in the spine of the clip. Spheroidality is the condition that arises when some of the material in the spine of the clip is bent simultaneously in two orthogonal directions. This cannot be done simply by bending—it requires the material to be stretched and/or sheared and/or compressed, and it results in a shape which cannot be 'developed' (unfolded) out onto a flat sheet.

In high volume manufacture, these stages may all be completed in a multi stage die in a progressive die machine. In this case, the unit cost of each clip can be very low.

The present invention is not limited to the two-bump embodiment. Some further embodiments of the present invention will now be described.

The humped embodiment, shown in FIG. 14, is similar to the two-bump embodiment except that region where the spine meets the upper surface is convex, forming a hump, instead of concave as a dimple.

Figure 15:
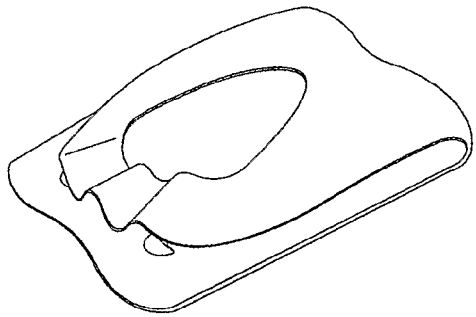
FIG. 15 shows a perspective view of the smooth embodiment, in the closed position.

The smooth embodiment, shown in FIG. 15, is similar to the two-bump embodiment except that the region where the spine meets the upper surface is neither convex nor concave, so the convex upper surface blends smoothly with the concave region between the two bumps of the spine. The smooth embodiment is aesthetically pleasing because it has simpler, cleaner lines but it is harder to manufacture because there is nowhere for the extra material from between the two bumps to move to, so the material in this region has to be stretched and/or sheared more than in the dimpled and humped embodiments.

The strut embodiment, versions of which are shown in FIGS. 16 and 20, is similar to the smooth embodiment, except that there is a strut 15 perpendicular to the axis of the spine which divides the hole, so the strut embodiment has two holes. The strut is in compression in both the clip's stable open state and its stable closed state, and the strut therefore behaves as another bucklable member. The strut therefore increases the stability of the clip in both its stable positions and can also increase the amount of movement in the upper surface of the clip.

The strut embodiment is easier to toggle from the closed to the open position than the two-bump embodiment because the user can apply pressure to the strut, instead of to the high point.

In preferred versions of the strut embodiment, there is a gap between the two crimps where the strut meets the nose.

The strut embodiment of the present invention shares several common features with WO96/21573, which also has a central compressive strut. However, in WO96/21573 the primary tension is in the arms (acting perpendicular to the axis of the spine) whereas in the present invention the primary tension is across the nose (acting parallel to the axis of the spine), or, in the case of the peened and coned embodiments of the strut embodiment, the primary tension is around the entire perimeter of the upper surface of the clip.

The basic mechanism of WO96/21573 is a linear compressive bucklable strut held in compression between a pair of linear tensile members, whereas the basic mechanism of preferred embodiments of the present invention is more like a Belleville Washer, in which a hoop tension around the outer edge of the upper surface of the clip is balanced by a hoop compression around (most of) the inner edge of the clip (the perimeter of the hole).

The bridge embodiment, a version of which is shown in FIG. 17, is similar to the smooth embodiment, except that there is a second hole between the main hole and the spine. The piece of material remaining between the two holes is called the bridge. As with the strut embodiment, the bridge embodiment is easier to toggle from the closed to the open position than the two-bump embodiment because the user can apply pressure to the bridge, instead of to the high point.

Also as with the strut embodiment, the bridge is in compression in both the clip's stable open and its stable closed state, so the bridge behaves as an additional bucklable member. The bridge is curved because it is in compression, and the curvature of the bridge may increase the curvature of the sides of the clip, which may further enhance the function of this embodiment.

Figure 24:
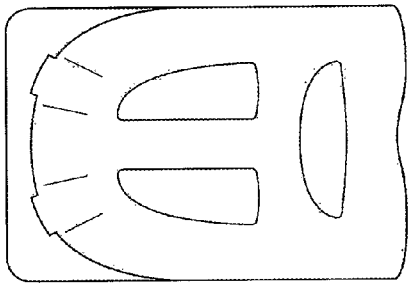
FIG. 24 shows a plan view of a three-hole embodiment.
Figure 25:
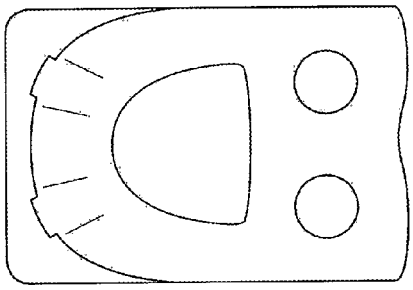
FIG. 25 shows a plan view of another three-hole embodiment.
Figure 26:
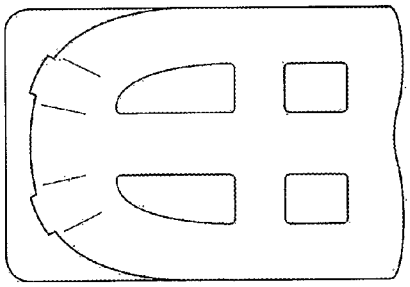
FIG. 26 shows a plan view of a four-hole embodiment.
Figure 27:
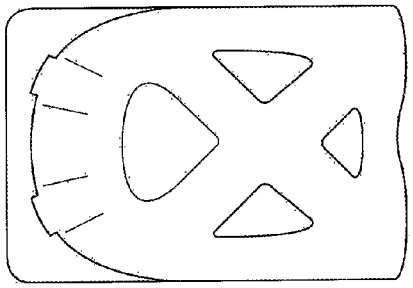
FIG. 27 shows a plan view of another four-hole embodiment.
Figure 28:
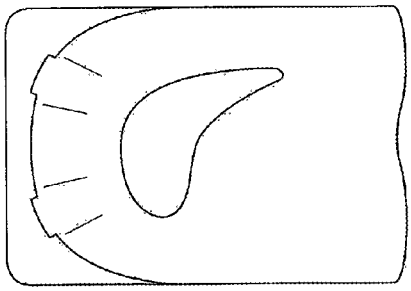
FIG. 28 shows a plan view of an asymmetric embodiment.

Three further embodiments can be made by combining the strut embodiment with the bridge embodiment to create either three or four holes in the upper surface, as shown in FIGS. 24-26. The configuration of the four holes can be changed again as shown in FIG. 27. Each of these embodiments has different mechanical, ergonomic and aesthetic characteristics, so each of these embodiments may be chosen to satisfy different requirements.

The aforementioned embodiments are all substantially symmetrical, but there may be advantages to asymmetric embodiments, one example of which is shown in FIG. 29.

The peened embodiment, shown in FIG. 18, is similar to the two-bump embodiment except that the compressive force around the perimeter of the hole is created not by crimps creating tension along the nose, but by peening along the inner edge (around the perimeter of the hole). The peening reduces the thickness of the material around the perimeter of the hole, and this reduction in thickness leads to a corresponding increase in the length of the inner edge, which creates compressive forces around the inner edge and corresponding tensile forces around the outer edge.

Figure 19:
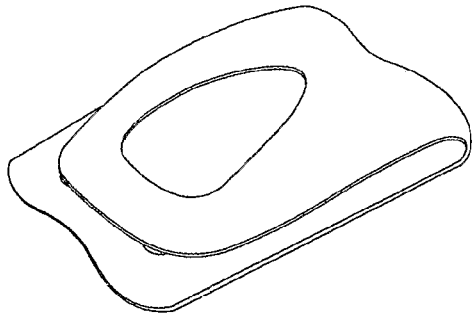
FIG. 19 shows a perspective view of the coned embodiment, in the closed position.

The coned hole embodiment, shown in FIG. 19, is similar to the peened embodiment in that the nose of the clip does not need to be crimped. In the coned hole embodiment, compressive forces around the perimeter of the hole are generated by plastically deforming the upper surface into the shape of a shallow cone, then reverse forming the upper surface to create a shallow cone in the opposite direction. This second (reverse) forming gives control over the residual stresses in the upper surface of the clip.

The peened embodiment and the coned hole embodiment are aesthetically simpler than the two-bump embodiment because they are not crimped. Also, it may be easier in high volume manufacture (eg in a progressive die machine) to peen the perimeter of the hole or to conically form then reverse form the upper surface than to crimp the nose of the clip. Furthermore, the elongated flange would be easier to implement on one of these embodiments as the elongated flange could conflict with the crimps.

The one bump embodiment, shown in FIG. 20, has a spine with just one bump instead of two. This does not make the spine as stiff as when there are two bumps, but it may be easier to manufacture.

A particular advantage of the preferred embodiments of the present invention is the fact that the clips nest together when in the open position, as shown in FIG. 13. This allows a large number of clips to be held in a relatively small amount of space, and also ensures that each clip is in the same orientation as the next clip, which will prevent them tangling with each other.

It will be understood from the description above and the figures that the embodiments described do not constitute the only feasible embodiments of the present invention, as the features described may be combined together in many different ways. For example, for any given clip with two bumps in the spine and just one hole in the upper surface:

1. The region where the spine meets the upper surface may be smooth, or may be dimpled, or may be humped;
2. The plastic deformation of the upper surface required to create the bistability of the upper surface may be achieved either by crimping the nose, or by peening the inner edge(s), or by coning and reverse-coning the hole;
3. The clip may either have, or not have, upper teeth and/or lower teeth, and/or upper and/or lower flanges;

Most of these variants would also be feasible with just one bump in the spine, or with one or two ridges in the spine, and/or with two or more holes in the upper surface as shown in the FIGS. 9-12, 20 and 24-28. They would also be feasible with spines which do not have a circular profile, as shown in FIG. 29.

It will be further understood that the present invention is potentially applicable to many different kinds of foldover clips, including but not limited to those described in the patents and patent applications referenced herein.

The invention claimed is:

1. A clip comprising a single piece of material folded around a bend axis extending in a first direction to form first and second members (3, 1) coupled at a fold (2), said clip arranged to receive an item or items to be held between said first and second members (3, 1), said first member (3) having an aperture (6) therein with at least some of the material around said aperture (6) being plastically deformed whereby said first member (3) has a first position of stability in which at least regions proximal to the free end (8) of said first member (3) have a generally convex shape and a second position of stability in which at least regions proximal to the free end (8) of said first member (3) have a generally concave shape, in which said fold (2) comprises a first cross-section orthogonal to said first direction and a second cross-section parallel to said first cross-section and displaced in said first direction from said first cross-section, characterized in that:

an internal radius of curvature of said first cross-section is smaller than an internal radius of curvature of said second cross-section and an external radius of curvature of said first cross-section is smaller than an external radius of curvature of said second cross-section, and also, for any said first cross section having a smaller internal radius of curvature than any other cross section parallel to said first cross section, the external radius of curvature of said first cross section is also smaller than the external radius of curvature of said any other cross section.

2. The clip according to claim 1, in which said plastic deformation is in the form of one or more crimps (9) or one or more further bends of a portion of said material at an opposite side of said aperture (6) from a position of said fold (2).

3. The clip according to claim 1, in which said plastic deformation comprises thinning and/or stretching of said material at the periphery of said aperture (6).

4. The clip according to claim 1, in which said first member (3) comprises a plurality of apertures (6).

5. The clip according to claim 1, wherein said second member (1) is provided with corrugations (4) running in a direction substantially perpendicular to said bend axis.

6. The clip according to claim 1, further comprising corrugations (4) extending around at least part of said fold (2) to create bumps (5) in said fold curved in two orthogonal directions.

7. The clip according to claim 1, in which said sheet material is sheet metal.

8. The clip according to claim 1, further comprising one or more teeth (10, 12) formed on one or both of said first and second members (3,1).

9. The clip according to claim 5, wherein the second member (1) has first and second major parallel surfaces, wherein the corrugations comprise at least two parallel folds in the material, resulting in at least one ridge in the first major surface of the second member (1), and resulting in at least one groove in the second major surface of the second member (1) aligned with and proximate to the at least one ridge.

10. The clip according to claim 6, wherein the second member (1) has first and second major parallel surfaces, wherein the corrugations comprise at least two parallel folds in the material, resulting in at least one ridge in the first major surface of the second member (1), and resulting in at least one groove in the second major surface of the second member (1) aligned with and proximate to the at least one ridge.

11. The clip according to claim 6, wherein the fold (2) has first and second major parallel surfaces, wherein the bumps comprise at least two parallel folds in the material, resulting in at least one ridge in the first major surface of the fold (2), and resulting in at least one groove in the second major surface of the fold (2) aligned with and proximate to the at least one ridge.

12. The clip according to claim 1, wherein said fold further comprises a third cross section parallel to said first cross-section and displaced in said first direction from said second cross-section, wherein an internal radius of curvature of said second cross-section is smaller than an internal radius of curvature of said third cross-section and an external radius of curvature of said second cross-section is smaller than an external radius of curvature of said third cross-section.

13. The clip according to claim 12, wherein said fold further comprises a fourth cross-section parallel to said first cross-section and displaced in said first direction from said third cross section, wherein an internal radius of curvature of said third cross-section is larger than an internal radius of curvature of said fourth cross-section, and an external radius of curvature of said third cross-section is larger than an external radius of curvature of said fourth cross-section.

14. The clip according to claim 1, wherein said fold comprises one or more plastically deformed regions configured to provide an increased bend stiffness in a direction around said bend axis.

15. The clip according to claim 1, wherein a thickness of the material in the fold does not have sudden thickness changes.

* * * * *

UNITED STATES PATENT AND TRADEMARK OFFICE

CERTIFICATE OF CORRECTION

PATENT NO. : 7,937,813 B2
APPLICATION NO. : 11/571308
DATED : May 10, 2011
INVENTOR(S) : Julian Claude Peck et al.

It is certified that error appears in the above-identified patent and that said Letters Patent is hereby corrected as shown below:

Column 1, line 18, delete “paperclip” and replace with --paperclips--.

Column 12, line 8, delete “(eg” and replace with --(e.g.--.

Column 12, line 38, delete “flanges;” and replace with --flanges.--.

Signed and Sealed this
Second Day of August, 2011

David J. Kappos

David J. Kappos
*Director of the United States Patent and Trademark Office*